US010013967B2

(12) United States Patent
Zafeiropoulos

(10) Patent No.: US 10,013,967 B2
(45) Date of Patent: Jul. 3, 2018

(54) METHOD AND SYSTEM FOR SELECTING SENSOR LOCATIONS ON A VEHICLE FOR ACTIVE ROAD NOISE CONTROL

(71) Applicant: Harman Becker Automotive Systems GmbH, Karlsbad (DE)

(72) Inventor: Nikos Zafeiropoulos, Straubing (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 0 days.

(21) Appl. No.: 15/592,755

(22) Filed: May 11, 2017

(65) Prior Publication Data

US 2017/0330551 A1 Nov. 16, 2017

(30) Foreign Application Priority Data

May 11, 2016 (EP) ..... 16169157

(51) Int. Cl.
*G10K 11/178* (2006.01)

(52) U.S. Cl.
CPC ..... *G10K 11/1788* (2013.01); *G10K 11/178* (2013.01); *G10K 2210/124* (2013.01); *G10K 2210/129* (2013.01); *G10K 2210/1291* (2013.01); *G10K 2210/12821* (2013.01); *G10K 2210/3018* (2013.01); *G10K 2210/3021* (2013.01); *G10K 2210/3022* (2013.01); *G10K 2210/3028* (2013.01); *G10K 2210/3046* (2013.01); *G10K 2210/3053* (2013.01); *G10K 2210/3055* (2013.01); *H04R 2499/13* (2013.01)

(58) Field of Classification Search
CPC ..... G10K 11/178; G10K 2210/1282
See application file for complete search history.

(56) References Cited

U.S. PATENT DOCUMENTS

2012/0150414 A1* 6/2012 Huang ..... F02D 35/024 701/101
2013/0233083 A1* 9/2013 Hofelsauer ..... G01H 1/12 73/649

FOREIGN PATENT DOCUMENTS

EP 671610 * 9/1995
EP 3159891 * 4/2017
GB 2239577 * 7/1991
(Continued)

OTHER PUBLICATIONS

Smallwood, "Matrix Methods for Estimating the Coherence Functions from Estimates of the Cross-Spectral Density Matrix", Shock and Vibration, vol. 3, No. 4, pp. 237-246, Jan. 1, 1996.
(Continued)

*Primary Examiner* — Mohammad Islam
(74) *Attorney, Agent, or Firm* — Brooks Kushman P.C.

(57) ABSTRACT

The present disclosure provides a method for determining an arrangement of reference sensors for active road noise control (ARNC) in a vehicle with an automatic calibration system. The method includes mounting a plurality of vibrational sensors on a plurality of structure elements of the vehicle to generate a plurality of vibrational input signals and mounting at least one microphone inside a cabin of the vehicle to capture at least one acoustic input signal. The method further includes determining an arrangement of reference sensors from the plurality of vibrational sensors by determining a subset of vibrational sensors which sense the main mechanical inputs of road noise contributing to the at least one acoustic input signal.

17 Claims, 5 Drawing Sheets

(56) References Cited

FOREIGN PATENT DOCUMENTS

| | | | |
|---|---|---|---|
| GB | 2257601 | * | 1/1993 |
| JP | 2006335136 A | | 12/2006 |
| WO | WO 2014050295 | * | 4/2014 |

OTHER PUBLICATIONS

Zafeiropoulos et al., "Active Control of Structure-Borne Road Noise Based on the Separation of Front and Rear Structural Road Noise Related Dynamics", SAE International Journal of Passenger Cars—Mechanical Systems, vol. 8, No. 3, May 15, 2015, pp. 886-891.

Duan, "Active Control of Vehicle Powertrain and Road Noise", University of Cincinnati, Jun. 1, 2011, 212 pages.

* cited by examiner

METHOD AND SYSTEM FOR SELECTING SENSOR LOCATIONS ON A VEHICLE FOR ACTIVE ROAD NOISE CONTROL

CROSS-REFERENCE TO RELATED APPLICATIONS

This application claims foreign priority benefits under 35 U.S.C. § 119(a)-(d) to EP Application Serial No. 16169157.1, filed May 11, 2016, the disclosure of which is hereby incorporated in its entirety by reference herein.

TECHNICAL FIELD

The present disclosure relates to a method and system for the automatic selection of reference sensor locations on a vehicle for active road noise control.

BACKGROUND

Land based vehicles such as cars and trucks when driven on roads generate low frequency noise known as road noise. As the wheels are driven over the road surface, such road noise is at least in part structure borne. That is to say, it is transmitted through structure elements of the vehicle such as tires, wheels, hubs, chassis components, suspension components such as suspension control arms or wishbones, dampers, anti-roll or sway bars and the vehicle body and can be heard in the vehicle cabin.

Until recently, the main approach for lowering the level of road noise in the vehicle cabin was to employ specifically optimized shapes and materials of the respective structure elements which attenuate vibrations and provide dedicated absorbers. This approach, however, generally leads to undesired constraints on the design of the vehicle as well as additional mass of the vehicle which adds to the overall fuel consumption.

Recently, active road noise control has been successfully applied to a number of vehicles using a high number of reference sensors mounted on structure elements of the vehicle contributing to the main transfer paths for road noise. The reference sensor locations are generally obtained by comparing various locations on a vehicle and their degrees of freedom (DoFs) that relate to the structure design of road noise transmitting components such as axles. Extensive simulations are often performed to determine the relation between critical structural locations that are influencing the Noise Vibration and Harshness (NVH) tuning of the vehicle and the reference sensor locations for active road noise control (ARNC) systems. In the ideal case, the reference sensors are placed such that they provide largely decorrelated signals which are coherent with the interior noise in the cabin. The ARNC systems process these signals from the reference sensors by applying digital filters to determine a, generally multi-channel, acoustic signal output by the speakers of the vehicle's audio system to cancel the transmitted road noise in a predetermined quiet zone which is typically arranged near the head rests for the driver and the passengers.

However, placement of the reference sensors can be a challenging task since the road noise performance of the vehicle can vary according to its structural design. From the NVH point of view, vibrations which are highly coherent with the interior noise are related with the structural dynamics of the vehicle and its axle design. In particular, the suspension and subframe architecture influence specific DoF that relate to the structural sensitivity of the structure.

Generally, signals from various reference sensors are at least partly correlated such that a reduction of the number of the reference sensors would be possible. The determination of the optimal number and location of the reference sensors on the vehicle structure has been the object of costly and time-consuming mathematical optimization algorithms. Also, Principal Component Analysis (PCA) that is applied on the cross-spectra density matrix of the reference signals has been used to decorrelate potentially correlated reference signals. The PCA is however too expensive to be performed in real time in ARNC systems implemented in present day vehicles.

The present disclosure provides a method and a system for the automatic determination of the optimal arrangement of reference sensors for ARNC which overcomes the above mentioned drawbacks. The described method is in particular highly efficient and computationally inexpensive and can be readily applied to various designs of vehicle structures. The present disclosure also provides an ARNC system using a plurality of reference sensors whose arrangement is determined using the disclosed method.

SUMMARY

The technical problems described above are solved by a method for determining an arrangement of at least one reference sensor for active road noise control (ARNC) in a vehicle by the automatic calibration system. The method includes mounting a plurality of vibrational sensors of the calibration system on a plurality of structure elements of the vehicle. The structure elements represent the strongest contributions to the transfer of road noise into a cabin of the vehicle. The vibrational sensors are configured to generate a plurality of vibrational input signals based on vibrations of the respective structure elements and to input the plurality of vibrational input signals to a processing unit of the calibration system. The method further includes mounting at least one microphone of the calibration system inside the cabin of the vehicle. The at least one microphone is configured to capture at least one acoustic input signal and to input the captured at least one acoustic input signal to the processing unit. The method further includes determining the arrangement of reference sensors from the plurality of vibrational sensors with the processing unit by determining a subset of vibrational sensors which sense the main mechanical inputs of road noise contributing to the at least one acoustic input signal.

The structure elements representing the strongest contributions to the transfer of road noise into the cabin of the vehicle may be determined based on axle design, contribution analysis or on numerical simulations such as computations of operational mode shapes of the suspension and axle that are used for structure borne road noise analysis as well as transfer path analysis for road noise. As described below in detail, multiple vibrational sensors may be mounted on different locations of a structure element. From the plurality of vibrational sensors, the subset of sensors which sense the main mechanical inputs of road noise contributing to the at least one acoustic input signal is determined. This determination is performed by determining the main contributions among the plurality of vibrational input signals to the at least one acoustic input signal.

The technical problems described above are also solved by a method for determining an optimal arrangement of at least one reference sensor for the ARNC in a vehicle with an automatic calibration system. The method includes mounting a plurality of vibrational sensors of the calibration system on a plurality of structure elements of the vehicle. The vibrational sensors are configured to generate a plurality of vibrational input signals based on vibrations of the respective structure elements and to input the plurality of vibrational input signals to a processing unit of the calibration system. The method further includes mounting at least one microphone of the calibration system inside a cabin of the vehicle. The at least one microphone is configured to capture at least one acoustic input signal and to input the captured at least one acoustic input signal to the processing unit. The method further includes forming a plurality of proper subsets of vibrational input signals from the plurality of vibrational input signals and calculating a multiple-coherence function for each of the subsets and for each of the at least one acoustic input signal using the processing unit to determine the coherence between the respective acoustic input signal and the vibrational input signals of the respective subset; and for each of the at least one acoustic input signal, automatically selecting, with the processing unit, a subset for which the multiple-coherence function is maximum as the optimal arrangement of reference sensors for ARNC of the acoustic signal.

The vehicle may be any road-based vehicle with a passenger cabin, in particular a car or a truck. The automatic calibration system may be provided as part of the vehicle, e.g., as part of a prototype of a specific vehicle, or as a standalone unit which is operated in a test environment for the vehicle, e.g., as part of a vehicle test stand, to determine the optimal arrangement of reference sensors on a prototype of a vehicle. Also, the automatic calibration system may be temporarily connected to the electronic system of the vehicle, by wires and/or wirelessly for performing the methods described herein. In order to perform the relevant tests with respect to the generation of road noise, the automatic calibration system may be connected to the ECU of the vehicle and control an operation of the engine of the vehicle.

The vibrational sensors of the calibration system can be any sensors configured to measure the vibration of the structure element of the vehicle at a point of the structure element they are attached to. The vibrational sensors may be configured to measure the vibration with respect to one, two or three DoFs, i.e., measure the vibration in one, two or three orthogonal directions. As a consequence, the vibrational sensors may output one, two or three vibrational input signals each, in particular as digital signals representing the respective measured vibrations. By way of example, accelerometers may be used as vibrational sensors which measure the acceleration of the respective mounting point in one, two or three directions. The vibrational sensors are configured to input the plurality of vibrational input signals to a processing unit of the calibration system. To this end, the vibrational sensors may be connected with the processing unit of the calibration system via wires and/or wirelessly. A wireless connection simplifies the test stand. Alternatively, the vibrational sensors may be connected to a control unit of the vehicle which collects the vibrational signals and transmits them, via cable or wirelessly, to the processing unit of the calibration system.

In any case, a significantly larger number of vibrational sensors are mounted on the plurality of structure elements as typically needed for the active road noise control whereas the number of reference sensors which are finally installed in the production vehicle as part of the active noise control system is significantly smaller. By way of example, eight 3D-accelerometers may be installed on each of a front axle and a rear axle and their related structure elements such as suspension control arms and anti-sway bars outputting a total of 48 vibrational input signals while only one vibrational input signal per uncorrelated force input might be needed. By way of example, two accelerometers measuring two-dimensional accelerations may be sufficient per axle. Consequently, the production vehicle and its ARNC system will be equipped with a much smaller number of (largely uncorrelated) vibrational sensors such that the demand for computational power of the ARNC system is significantly reduced. As mentioned above, vibrational sensors may be mounted on any structure element suspected or known to transmit road noise to the vehicle cabin. Examples are the subframe of the vehicle, the chassis of the vehicle, tires, suspension structure elements such as control arms, wishbones, dampers, anti-roll or sway bars, wheels, hubs, etc. The locations for mounting the plurality of vibrational sensors may be selected based on axle design, contribution analysis or on numerical simulations such as computations of operational mode shapes of the suspension and axle that are used for structure borne road noise analysis as well as transfer path analysis for road noise. They are ideally selected to include the main transfer paths for road noise such that at least one strongly coherent vibrational input signal per force input or DoF is captured.

Differently from other methods, the present method explicitly allows providing more vibrational input signals than uncorrelated sources for the road noise such that the resulting vibrational input signals are not linearly independent. As a result, multiple vibrational sensors can be mounted in close proximity on the same structure element to provide partially correlated input signals, in particular if these vibrational sensors are assigned to different subsets of the method. The disclosed calibration method will then automatically determine the best suited sensor from such a group of redundant vibrational sensors for a decorrelated subset of input signals.

At least one microphone of the calibration system is mounted inside the cabin of the vehicle. The at least one microphone is configured to measure the sound inside the cabin of the vehicle and to convert the measured sound into at least one acoustic input signal. While all possible efforts are usually made to avoid the presence of other sounds, such as wind noise and other vehicle sound, sounds transmitted from outside the vehicle or internally generated sounds such as music or speech, a filter may be provided as part of the calibration system or the vehicle's audio system to filter out such unwanted sounds from the acoustic signal captured by the microphones. The microphones may be provided as temporarily mounted microphones of the calibration system or as permanently installed microphones of the ARNC system. As such, the microphones may in particular be the error microphones of the below described ARNC system, in which case the acoustic input signal is input to the processing unit of the calibration system via the vehicle's audio system, e.g., by connecting the calibration system to the vehicle's audio system. The microphones may be mounted in the head room, e.g., on or near the headrest, of the driver seat and/or the passenger seats or in the headliner of the vehicle as headliner microphones above the respective headrests. As a result, the at least one acoustic input signal is representative of the road noise transmitted into the audio zone of the driver and/or the passengers.

From the plurality of vibrational input signals a plurality of proper subsets is formed. To be able to eliminate all unwanted road noise, the number of vibrational input signals of each of the proper subsets can be selected to be larger than or equal to the number of uncorrelated force inputs. If this number is unknown, subsets with different sizes may be formed to provide the possibility to determine the optimal number of reference sensors in addition to their optimal arrangement. In particular, subsets being proper subsets of other subsets or even hierarchies of subsets, each comprising the subset of the following lower level, may be formed as part of the plurality of proper subsets. Also, overlapping subsets may be formed to identify major contributions to the multiple-coherence function from their intersection. Finally, earlier expertise on the transfer paths for road noise may enter the definition of the subsets. By way of example, subsets may be formed which comprise only sensors associated with the front portion, in particular the front axle, of the vehicle, while other subsets may be formed which comprise only sensors associated with the rear portion, in particular the rear axle, of the vehicle, to determine the contributions of road noise arising from the front wheels or back wheels of the vehicle. Also, subsets may be formed comprising only sensors mounted on the vehicle body to determine contributions of road noise arising from wind friction. The number of subsets may range from one subset per suspected source of road noise to the maximum number of different subsets, including subsets with only one vibrational input signal. Also, input signals associated with different dimensions from the same multi-dimensional sensor may be placed in the same subset, if they are expected to be decorrelated, or in different subsets, if they are expected to be correlated.

The subsets may be formed through user input, e.g., by an engineer, or automatically based on vehicle data stored in a database and the mounting points of the vibrational sensors. In the latter case, the calibration system may comprise a corresponding database or read the relevant data from a database provided by the vehicle maker.

Once the vibrational sensors and microphones are mounted, the vehicle may be operated under test conditions to determine the transmission of road noise from the sources to the cabin of the vehicle. This may be done on a vehicle test stand such as a roller bench in an anechoic chamber to avoid unwanted reflections of the road noise or by driving the vehicle on road. In either case, an effort shall be made to operate the vehicle under substantially constant conditions, e.g., in terms of speed and road surface, to produce largely stationary vibrational signals such that their spectral compositions may be assumed to be constant over time. The plurality of vibrational sensors and the at least one microphone measure the vibrations of the respective structure elements and the sound field in the cabin during the test and generate corresponding vibrational input signals and acoustic input signals.

For each of the at least one acoustic input signal, the processing unit of the calibration system then calculates a multiple-coherence function for each of the subsets to determine the coherence between the respective acoustic input signal and the vibrational input signals of the respective subset. The multiple-coherence function may be calculated as the frequency-dependent sum of the normalized cross-power spectra between the respective acoustic input signal and the virtual vibrational signals calculated from the auto- and cross-power spectra matrix of the vibrational input signals of the respective subset. Thus, the multiple-coherence function is a frequency-dependent function representing the total coherence between the acoustic input signal and the vibrational input signals of the subset. As the subset is a proper subset, this multiple-coherence is generally smaller than 1, wherein a value close to 1 indicates a strong correlation of the acoustic input signal with the input signals from the vibrational sensors of subset. The present automatic calibration method aims at identifying the minimum subset of sensors to effectively capture a source of road noise.

To this end, the processing unit automatically selects a subset as the optimal arrangement of reference sensors for ARNC for each of the at least one acoustic input signal. Depending on the way the subsets are formed, the selection criteria for this automatic selection may vary. By way of example, only subsets may be formed which are not proper subsets of another subset, i.e., subsets which do not overlap another subset completely. For example, all subsets may have the same size. In this case, the processing unit may automatically select the subset for which the multiple-coherence function is maximum. As the multiple-coherence function is generally frequency-dependent this maximum may be determined for a particular frequency or a particular frequency band as described below or may be based on the global maxima of the entire multiple-coherence functions. The sensors of the selected subset then automatically provide the best set of sensors for the capture of the noise source. In the case of subsets which fully include other subsets of the plurality of subsets, the larger subsets will always have a larger multiple-coherence then the smaller subsets as they include more vibrational input signals. In this case, the increase of the multiple-coherence with respect to the number of input signals may be used to select the subset for the reference sensors. If the increase drops below a given threshold, a further increase of the size of the subset would not produce a significantly better representation of the source. In other words, adding a sensor signal which is highly coupled or correlated with the sensor signals already in the subset does not add a significant increase to the resulting multiple-coherence function. Thus, the smaller subset is chosen for the set of reference sensors.

The selected subsets may be different for different acoustic input signals because the transfer path from the sources to the corresponding location of the corresponding microphone may differ. As an example, road noise from the left hand side of the vehicle may be more dominant for the acoustic input signal captured by a microphone in the head room of the driver than road noise from the right hand side of the vehicle. If different subsets are selected for different acoustic input signals, the production vehicle may be equipped with all the reference sensors which are needed to produce the vibrational input signals of the combined subsets. The below described ARNC, however, may be performed for the individual locations of the microphones, i.e., the respective head rooms, based on the vibrational input signals of the individual subsets.

An exemplary way of calculating the multiple-coherence function will be described further below.

The above-described method allows for an automatic determination of an optimal arrangement of reference sensors, both with respect to the mounting positions of the reference sensors and the number of reference sensors, which may then be used to implement an ARNC system in the production vehicle. Only limited knowledge of the transfer paths for road noise in the analyzed vehicle is required to place the larger set of vibrational sensors and to form the plurality of proper subsets. User input or data from a database may be used to form the subsets. The calibration method and system calculate the multiple-coherence functions for each of the subsets and automatically determine the optimal arrangement from the result. As the subsets are generally significantly smaller than the plurality of vibrational sensors due to the elimination of correlated vibrational input signals, the ARNC system and algorithm can work very efficiently and in real time. The calibration method is furthermore computationally efficient as the involved auto- and cross-spectra matrices of the smaller subsets require significantly less computational power than the full matrix of all vibrational input signals.

According to one embodiment, the method may further comprise determining a road noise spectrum from the at least one acoustic input signal with the processing unit and determining at least one resonance frequency from the road noise spectrum with the processing unit. The method further includes automatically selecting, with the processing unit, a first subset for which the multiple-coherence function evaluated at a first determined resonance frequency is maximum as the optimal arrangement of reference sensors. The road noise spectrum at the location of the at least one microphone may be determined by processing a time series of the captured at least one acoustic input signal using the processing unit. The processing unit may perform a Fourier transform, in particular a Fast Fourier Transform (FFT), on the sampled acoustic input signal and produce the frequency-dependent sound pressure level as the road noise spectrum.

The spectrum may be divided into a low-frequency noise range, e.g., 0-100 Hz, a mid-frequency noise range, e.g., 100-500 Hz, and a high-frequency noise range, e.g., above 500 Hz. From these ranges, the low-frequency and mid-frequency ranges are usually the most relevant in terms of passenger comfort and road noise contributions. Individual sources of road noise, i.e., decorrelated force inputs, generally lead to more or less isolated resonances which can be found in the road noise spectrum. The method according to the present embodiment processes the road noise spectrum with the processing unit to determine at least one resonance frequency, wherein the processing may be limited to the low-frequency range and/or the mid-frequency range.

The method then aims at identifying those vibrational input signals which contribute to the first determined resonance by automatically selecting a first subset for which the multiple-coherence function evaluated at the first determined resonance frequency is maximum. To this end, the processing unit compares the values of the multiple-coherence function for the subsets at the first resonance frequency. The subset with the highest multiple-coherence value is the best candidate for representing the sources of the resonance. As described above, subsets which do not comprise other subsets are preferentially used for this kind of selection criterion. Other selection criteria may be used with different ways of forming the subsets as described above.

The method may further comprise automatically selecting, with the processing unit, a second subset for which the multiple-coherence function evaluated at a second determined resonance frequency is maximum, and combining the first and second subsets to determine the optimal arrangement of reference sensors. This process may be repeated for a third and further determined resonance frequencies. The processing unit may in particular determine all resonance frequencies in the road noise spectrum or the low-frequency range and/or mid-frequency range of the road noise spectrum for which the sound pressure level exceeds a predetermined threshold which may be set as the noise level above which discomfort is caused to the passengers.

By combining the first and second subsets, it is ensured that the first and second resonances can be cancelled out by the active road noise control system. If the first and second subsets are identical, the ARNC system may perform filtering on the vibrational input signals for both resonance frequencies at the same time. Otherwise, the vibrational input signals may be filtered independently from each other to account for their independent transfer paths. The described method allows quickly determining the optimal arrangement of reference sensors for the ARNC of a plurality of road noise resonances.

According to an embodiment, calculating the multiple-coherence function may comprise: processing a time series of the vibrational input signals by the processing unit to compute an auto- and cross-power spectra matrix of the respective vibrational input signals for each of the subsets, performing singular value decomposition of the resulting auto- and cross-power spectra matrices by the processing unit to determine diagonal power spectrum matrices with respect to virtual vibration signals, and calculating the multiple-coherence functions for the subsets based on cross-power spectra between the virtual vibration signals and the at least one acoustic input signal.

The sampled time series of the vibrational input signals $x(t)=[x_1(t),x_2(t) \ldots x_k(t)]$ of a subset may be divided into timeblocks and processed by performing an FFT transform of the timeblocks. From the resulting frequency samples, the auto- and cross-power spectra matrix $$S_{xx}(f)=\begin{pmatrix} S_{x_1x_1}(f) & \ldots & S_{x_1x_k}(f) \\ \vdots & \ddots & \vdots \\ S_{x_kx_1}(f) & \ldots & S_{x_kx_k}(f) \end{pmatrix}$$

is calculated for the vibrational input signals of the respective subset. This process is repeated for each of the subsets.

The matrices $S_{xx}(f)$ are then diagonalized by performing singular value decomposition to determine diagonal power spectrum matrices $$S_{virtual}(f)=\begin{pmatrix} S_{x_{v1}x_{v1}}(f) & \ldots & 0 \\ \vdots & \ddots & \vdots \\ 0 & \ldots & S_{x_{vk}x_{vk}}(f) \end{pmatrix}$$

with respect to virtual vibration signals. The diagonal elements of these matrices can be considered as the auto-power spectra of the principal components of the matrices $S_{xx}(f)$ which are totally uncorrelated. They thus represent the auto-power spectra of virtual vibration signals which result from linear combinations of the original vibrational input signals that are formed such that the resulting virtual vibration signals decouple. In an ideal situation, the sensors of the subset are already placed such that the vibrational input signals decouple such that the matrix $S_{xx}(f)$ is largely diagonal. As this is generally not the case, the above singular value decomposition is performed by the processing unit to determine the virtual power spectra. A decoupling of the input signals is required in the present method to calculate the multiple-coherence functions for the subsets.

Starting from the virtual power spectra matrices, frequency lines of the virtual vibration signals can be obtained which can be multiplied with Fourier transformed timeblocks of a sampled time series of the at least one acoustic input signal to calculate the cross-power spectra $S_{x_iy_j}$ between the virtual vibration signals and the at least one acoustic input signal, wherein $i=1 \ldots k$ and $y_j$ denotes the sampled time series of the j-th acoustic input signal.

The multiple-coherence function may then be calculated as the sum $$\gamma_{j:n}^2(f) = \sum_{i=1}^{k} \frac{|S_{x_{vi}y_j}(f)|^2}{S_{x_{vi}x_{vi}}(f)S_{y_jy_j}(f)}$$

over the cross-power spectra between all virtual vibration signals of the respective subset and the j-th acoustic input signal, normalized to the auto-power spectrum of the virtual vibration signals and the acoustic input signal, wherein n indicates an index for numbering the subsets.

The multiple-coherence function $\gamma_{j:n}(f)$ is calculated for all subsets n and each acoustic input signal j to determine the optimal arrangements of reference sensors as described above. The value of the multiple-coherence functions vary between 0 and 1, wherein 1 indicates full correlation of the vibrational input signals of the respective subset and the respective acoustic input signal, i.e., 100% contribution of the sensor locations to the interior road noise. As the computational cost of the singular value decomposition strongly increases with the size of matrix, generally with the size cubed, large matrices, i.e., auto- and cross-power spectra matrices for large sets of vibrational input signals, can hardly be decomposed in a reasonable time frame with the computing power available in today's vehicles such that real time ARNC based on an unstructured and large set of reference sensors is not possible. The described method allows selecting strongly reduced subsets from a larger plurality of sensors which still suffice to effectively capture the noise sources for the most relevant resonances. For the reduced subsets, which may for instance comprise as few as three vibrational input signals, singular value decomposition may be performed by the ARNC system in real time such that the assumption of stationary signals, which is hardly valid during real-world operation of a vehicle, can be dropped. The result is an effective cancellation of variable road noise and a significant improvement of passenger comfort.

Alternative ways of calculating the multiple-coherence function may be used. By way of example, an inverse of the auto- and cross-power spectra matrix of the vibrational input signals may be calculated by the processing unit and multiplied on both sides with vectors of the cross-power spectra between the vibrational input signals and the at least one acoustic input signal and the result may be normalized to the auto-power spectrum of the at least one acoustic input signal to calculate the squared multiple-coherence function.

The above described calculation of the multiple-coherence function based on virtual vibration signals may further comprise determining by the processing unit for at least one of the subsets a pair of vibrational input signals having the largest cross-power spectrum of the computed auto- and cross-power spectra matrix, automatically eliminating one of the two vibrational input signals of the pair and the corresponding vibrational sensor from the subset, and calculating the multiple-coherence function for the reduced subset.

If the vibrational input signals of a specific subset are at least partially correlated, the rank of the corresponding virtual power spectrum matrix will be smaller than its dimension. In other words, one or more eigenvalues of the auto- and cross-power spectra matrix of the vibrational input signals, and thus of the diagonal elements of the virtual power spectrum matrix, will be (close to) zero. In this case, the vibrational input signals can be written as linear combinations of a reduced number of uncorrelated signals, which are principal components of the auto- and cross-power spectra matrix. To generate these uncorrelated signals, the sensors would, however, have to be moved to different mounting points which are hard to determine. A simpler approach is taken in the present method by analyzing the auto- and cross-power spectra matrix to determine the pair of vibrational input signals with the largest cross-power spectrum. To this end, the absolute values of the cross-power spectra are compared. A large absolute value of the cross-power spectrum indicates a strong correlation, i.e., coherence, of the two contributing input signals. Consequently, one of the pair of vibrational input signals may safely be eliminated without strongly affecting the multiple-coherence function. If the eliminated vibrational input signal is the only input signal from a particular vibrational sensor for the present subset, this sensor can also be eliminated from the subset of sensors corresponding to the subset of input signals such that a reduced subset may be formed. In other words, vibrational sensors which generate input signals coherent with each other can be reduced to a single sensor location. In this way, the number of reference sensors may be optimized in a sense that only strongly decorrelated sensor signals enter the ARNC calculation.

The one of the two vibrational input signals may be eliminated only if the corresponding cross-power spectrum is larger or equal than a predetermined threshold. Again, absolute values of the cross-power spectra may be compared with the threshold. Setting a threshold for the elimination process ensures that no uncorrelated signals are eliminated from the subset. A typical threshold may for instance be set to a value between 0.7 and 0.9.

In one embodiment, the plurality of vibrational sensors may comprise at least a first group of vibrational sensors and a second group of vibrational sensors. The first group is mounted on structure elements associated with the front of the vehicle, in particular with a front axle of the vehicle, and the second group is mounted on structure elements associated with the rear of the vehicle, in particular with a rear axle of the vehicle. The subsets of vibrational input signals are formed so as to not combine vibrational input signals from different groups. Other or additional groups may be formed, for instance a group of sensors associated with the left hand side of the vehicle and a group of sensors associated with the right hand side of the vehicle. The groups may further intersect, in which case the subsets are formed so as to include only vibrational input signals from sensors of one group at a time.

Structure elements associated with the front axle of a vehicle may for instance include the axle itself, the front wheels and tires, the front suspension components such as control arms or wishbones, dampers, anti-roll or sway bars, subframe mounts, and the like. The same holds for the rear axle, respectively. By grouping the sensors according to the functional group of structure elements which they are mounted on, a pre-decorrelation of the plurality of vibrational sensor signals is introduced as the coherence between vibrations of the structure elements of the first group and vibrations of the structure elements of the second group after their transmission into the cabin of the vehicle is usually very small due to the significantly different transfer paths, even if the vibrational input signals themselves may be partly coherent. This pre-grouping, which can be done via user input or automatically based on a vehicle design or structure database and the mounting points of the sensors, thus further simplifies and improves the selection process.

The present disclosure further includes an automatic calibration system for determining an arrangement of one or more reference sensors for active road noise control (ARNC) in a vehicle. The system comprises: a processing unit; a plurality of vibrational sensors mountable on a plurality of structure elements of the vehicle and configured to generate a plurality of vibrational input signals based on vibrations of the respective structure elements and to input the plurality of vibrational input signals to the processing unit. The structure elements represent the strongest contributions to the transfer of road noise into a cabin of the vehicle. At least one microphone is mountable inside the cabin of the vehicle and configured to capture at least one acoustic input signal and to input the captured at least one acoustic input signal to the processing unit. The processing unit is configured to determine the arrangement of reference sensors from the plurality of vibrational sensors by determining a subset of vibrational sensors which sense the main mechanical inputs of road noise contributing to the at least one acoustic input signal.

The present disclosure also includes an automatic calibration system for determining an optimal arrangement of reference sensors for ARNC in a vehicle. The system comprises: a processing unit, a plurality of vibrational sensors mountable on a plurality of structure elements of the vehicle and configured to generate a plurality of vibrational input signals based on vibrations of the respective structure elements and to input the plurality of vibrational input signals to the processing unit, and at least one microphone mountable inside a cabin of the vehicle and configured to capture at least one acoustic input signal and to input the captured at least one acoustic input signal to the processing unit. The processing unit comprises a multiple-coherence calculation unit configured to calculate a multiple-coherence function for each of a plurality of proper subsets of vibrational input signals formed from the plurality of vibrational input signals and for each of the at least one acoustic input signal to determine the coherence between the respective acoustic signal and the vibrational input signals of the respective subset. A selection unit is configured to automatically select, for each of the at least one acoustic input signal, a subset based on the calculated multiple-coherence function as the optimal arrangement of reference sensors for ARNC of the acoustic input signal.

Equivalent modifications and extensions as described above with respect to the method for determining an optimal arrangement of reference sensors for ARNC may also be applied to the automatic calibration system. In particular, the vibrational sensors and the microphones may input their respective signals to the processing unit of the automatic calibration system directly, e.g., via cable or wirelessly, or indirectly by first inputting the signals to a control unit of the vehicle, in particular a control unit of an ARNC system of the vehicle which inputs the signals to the processing unit of the calibration system via cable or wirelessly. As described above, the automatic calibration system may be provided as part of the ARNC system of the vehicle or as a standalone system which is only temporarily connected with the vehicle. The processing unit may be any kind of electronic processing device, particularly a CPU or GPU as used in embedded systems, a digital signal processor (DSP), or a field-programmable gate array (FPGA) or an application-specific integrated circuit (ASIC). As mentioned above, the processing unit comprises a multiple-coherence calculation unit and a selection unit as subunits, e.g., as FPGAs or ASICs. The multiple-coherence calculation unit and the selection unit may also be provided as modules of computer-executable instructions of a computer program product, comprising one or more computer readable media having computer-executable instructions for performing the processing steps of the above described methods. The processing unit may thus be configured to execute the processing steps, described above and in the following as being performed by corresponding subunits of the processing unit, by executing corresponding modules of computer-executable instructions.

As described above, accelerometers may be used as the vibrational sensors which output one-, two- or three-dimensional vibrational input signals. The at least one microphone may be provided as a microphone which is temporarily mounted inside the cabin of the vehicle or as part of the ARNC system of the vehicle, e.g., as an error microphone mounted in the head room of a driver and/or a passenger of the vehicle, e.g., inside or near the headrest, for instance as a headliner microphone. The at least one microphone may also be provided as part of an engine order cancellation (EOC) system. The processing unit may further comprise a digital filter to remove unwanted, i.e., not road noise related, signals such as speech or wind noise from the captured acoustic input signal before further processing it. Also, the automatic calibration system may comprise a vehicle database including data with respect to design and functionality of structure elements of the vehicle under test. This database may also be provided separately, e.g., by a vendor of the vehicle, and may be accessed by the automatic calibration system via a wireless connection unit of the calibration system. Further elements known in the art may be provided as part of the calibration system as needed.

In one embodiment, the multiple-coherence calculation unit may further comprise a Fourier transform unit configured to process a time series of the vibrational input signals to compute an auto- and cross-power spectra matrix of the respective vibrational input signals for each of the subsets, and an eigenvalue calculation unit to perform singular value decomposition of the resulting auto- and cross-power spectra matrices to determine diagonal power spectrum matrices with respect to virtual vibration signals. The multiple-coherence calculation unit is configured to calculate the multiple-coherence functions for the subsets based on cross-power spectra between the virtual vibration signals and the at least one acoustic input signal. Again, the same modifications and variations as described above with respect to the calibration method may be applied to the functionality of the multiple-coherence calculation unit. As described above the frequency samples needed for the calculation of the cross-power spectra between the virtual vibration signals and the at least one acoustic input signal can be calculated from the diagonal power spectrum matrices and by Fourier transforming a sampled time series of the at least one acoustic input signal.

The multiple-coherence calculation unit may further comprise a subset size reduction unit configured to determine a pair of vibrational input signals having the largest cross-power spectrum of the computed auto- and cross-power spectra matrix for at least one of the subsets, and to eliminate one of the two vibrational input signals of the pair and the corresponding vibrational sensor from the subset, wherein the multiple-coherence calculation unit is further configured to calculate the multiple-coherence function for the reduced subset. As discussed above, absolute values of the auto- and cross-power spectra matrix may be compared to account for complex or negative values. Also, the elimination may only be performed if the respective cross-power spectrum value is larger than a predetermined threshold. Which of the two vibrational input signals is eliminated may be randomly chosen. However, preferably vibrational signals which allow elimination of the respective sensor as well because no other vibrational signals are provided by the sensor are eliminated. Also, vibrational signals which have already been eliminated in other subsets are preferably eliminated. The subset size reduction unit ensures that the minimum number of required reference sensors is identified to effectively cancel out a specific road noise resonance.

As described above, the multiple-coherence calculation unit may further be configured to determine a road noise spectrum from the at least one acoustic input signal, to determine at least one resonance frequency from the road noise spectrum and to automatically select a first subset for which the multiple-coherence function evaluated at a first determined resonance frequency is maximum as the arrangement of reference sensors. Similarly a second, third and further subsets may be selected for each of the determined resonance frequencies, wherein the range of the road noise spectrum considered may be limited to the low-frequency and/or mid-frequency range as described above.

The automatic calibration systems described above serve to identify an optimal arrangement of reference sensors for an ARNC system of a specific vehicle in an efficient and reliable way. The resulting arrangement of reference sensors may then be applied to the corresponding production vehicle to allow for real-time active road noise control at reasonable computational and constructional costs.

The present disclosure further includes an ARNC system installed in a vehicle which comprises a plurality of reference sensors mounted on a plurality of structure elements of the vehicle and configured to generate a plurality of reference signals based on vibrations of the respective structure elements. The mounting positions and the number of the reference sensors are obtainable by determining the optimal arrangement of the reference sensors using the above described calibration methods and systems. An adaptive filter system is configured to generate a cancellation signal based on the plurality of reference signals and a plurality of transfer functions for the reference signals with respect to a predetermined quiet zone in a cabin of the vehicle, and a speaker arrangement in the cabin of the vehicle is adapted to output an acoustic signal based on the cancellation signal such that road noise transmitted into the cabin of the vehicle is cancelled in the quiet zone.

The reference sensors may be the same as those used for the determination of the optimal arrangement or at least of the same type. They may be connected to the ARNC system via cables or wirelessly and be provided as accelerometers. The ARNC system may in particular be part of the vehicle's audio system. As such, the speaker arrangement and the below mentioned error microphones may already be provided as part of the audio system. Also, the adaptive filter system may be part of an adaptive filter system of the audio system or include further functionality with respect to audio filtering such as noise cancellation based on air-borne noise, filtering of audio signals, e.g., for voice control and hands-free telephony, or the like. The cancellation signal may be a multi-channel signal generated to be output by a plurality of speakers or speaker channels. It may in particular include phase information required to provide effective cancellation of the road noise resonances in one or several quiet zones, which are typically located in the area of the heads of the driver and one or more passengers. Beamforming may be used to cancel the road noise in these quiet zones. Respective systems and filters are known in the art such that a description thereof is omitted here for clarity.

The mounting positions and the number of the reference sensors is obtained by applying the above described methods and systems. In other words, the reference sensors are placed at locations and configured to generate a plurality of reference signals such that multiple-coherence functions between the reference signals and acoustic input signals captured by error microphones in the quiet zones, which are calculated for particular road noise resonance frequencies, are maximized.

The adaptive filter system may comprise a processing unit, such as a CPU or GPU, or may interact with a control unit or processing unit, such as a DSP audio processing unit, of the vehicle's audio system to generate the cancellation signal.

The ARNC system may further comprise at least one error microphone provided in the quiet zone and configured to capture an acoustic error signal, i.e., a remnant noise signal after road noise cancellation, wherein the adaptive filter system is further configured to update one or more filter coefficients so that the error signal is minimized. In addition to the feed-forward processing of the adaptive filter system based on the reference signals from the reference sensors, the ARNC system thus also provides feedback processing using the error signals from the error microphones. The updating of the filter coefficients may thus serve to eliminate air-borne road and tire noise and other noise sources. The error signal may be pre-processed by the audio system of the vehicle to eliminate audio signals and/or voice signals from the error signal before updating the filter coefficients such that these signals are not cancelled in the quiet zone. Further components may be added as known in the art to integrate the ARNC system with existing audio systems of the vehicle.

BRIEF DESCRIPTION OF THE DRAWINGS

Further features and exemplary embodiments as well as advantages of the present disclosure will be explained in detail with respect to the drawings. It shall be understood that the present disclosure should not be construed as being limited by the description of the following embodiments. It shall furthermore be understood that some or all of the features described in the following may also be combined in alternative ways.

DETAILED DESCRIPTION

Figure 1:
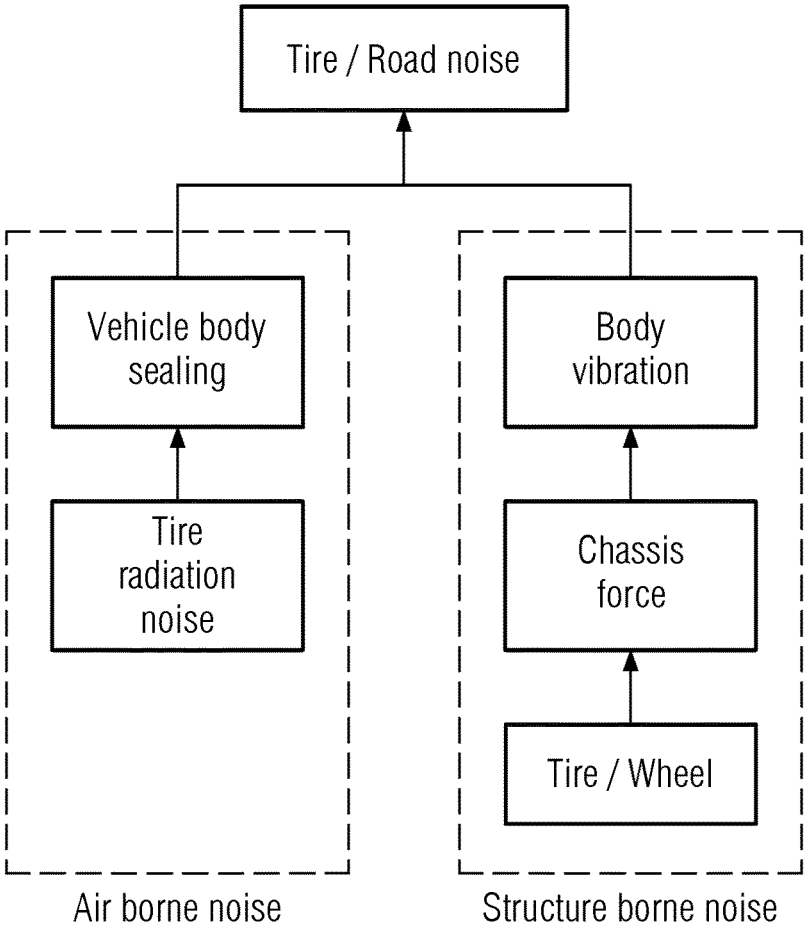
FIG. 1 shows a schematic diagram of the transfer paths of tire/road noise into a vehicle cabin.

FIG. 1 shows the transfer paths of tire/road noise into a vehicle cabin schematically. One contribution comes directly from tire radiation noise and is called air borne noise or directly transmitted noise. Air borne noise is influenced by two factors: the level of radiation noise generated during tire/road interaction and the acoustic performance of the vehicle body sealing. The other contribution is from so-called structure borne noise where vibration transfers through the chassis to the body and radiates noise into the vehicle cabin. Structure borne noise is influenced by the transfer function of tire/road force, tire/wheel exciting force attenuation and the transfer characteristics of the suspension. The last depends on dynamic stiffness of the chassis and the sensitivity of the body. Determination of the exact transfer paths for structure borne road noise has proven quite a challenging task, with results which strongly vary depending on the vehicle structure. As a result, active road noise control remained incomplete in terms of effective cancellation of all road noise resonances in the vehicle cabin.

The present disclosure deals with the cancellation of structure borne noise and a method and system for the optimal arrangement of a plurality of vibrational sensors for a feedforward active road noise control inside a vehicle cabin.

Figure 2:
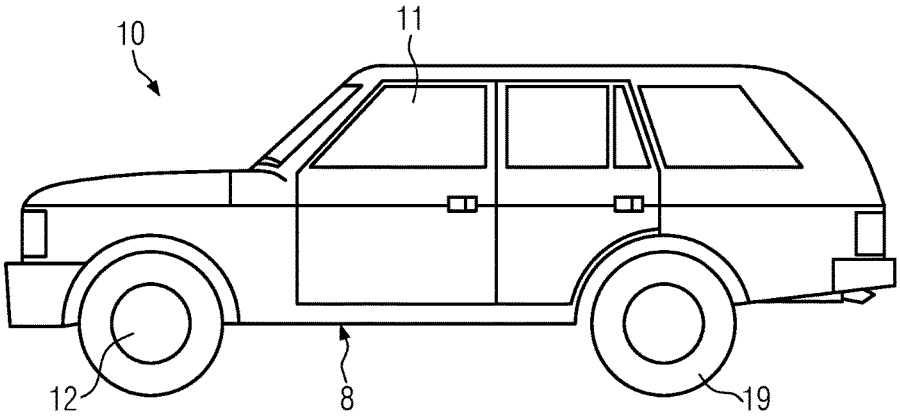
FIG. 2 shows a schematic side view of a vehicle.

FIG. 2 shows a schematic side view of a vehicle 10. A typical vehicle 10, i.e., a car, comprises a pair of front wheels 12 and a pair of rear wheels 19, a cabin 11 and a vehicle body 8. In this disclosure, structure elements are associated with the front of the vehicle if they are related to the front wheels and/or their suspension. Similarly, structure elements are associated with the rear of the vehicle if they are related to the rear wheels and/or their suspension. The front and rear wheels 12 and 19 are coupled to the vehicle body 8 by a vehicle chassis. Vehicle chassis as used herein relates to any structure component which couples the front and/or rear wheels 12, 19 to the vehicle body 8 and can articulate or move relative to the vehicle body 8. The structure elements associated with the front of the vehicle are thus part of the vehicle chassis or part of the tire/wheel system. The same holds for the structure elements associated with the rear of the vehicle.

The vehicle chassis and thus the structure elements mentioned herein may comprise, but are not limited to control arms, wishbones, subframes, dampers, springs, struts, wheel hubs, knuckles, anti-roll bars or anti-sway bars and/or steering components such as a steering rack.

Figure 3:
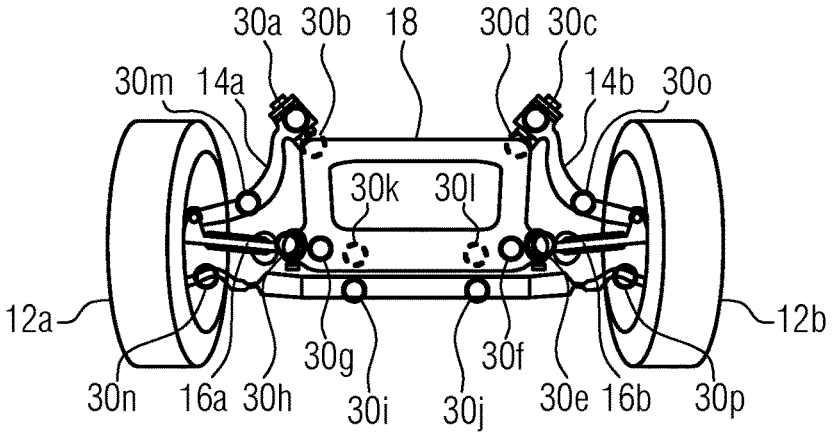
FIG. 3 shows a plan view from below of a front axle and suspension of the vehicle according to FIG. 2.
Figure 4:
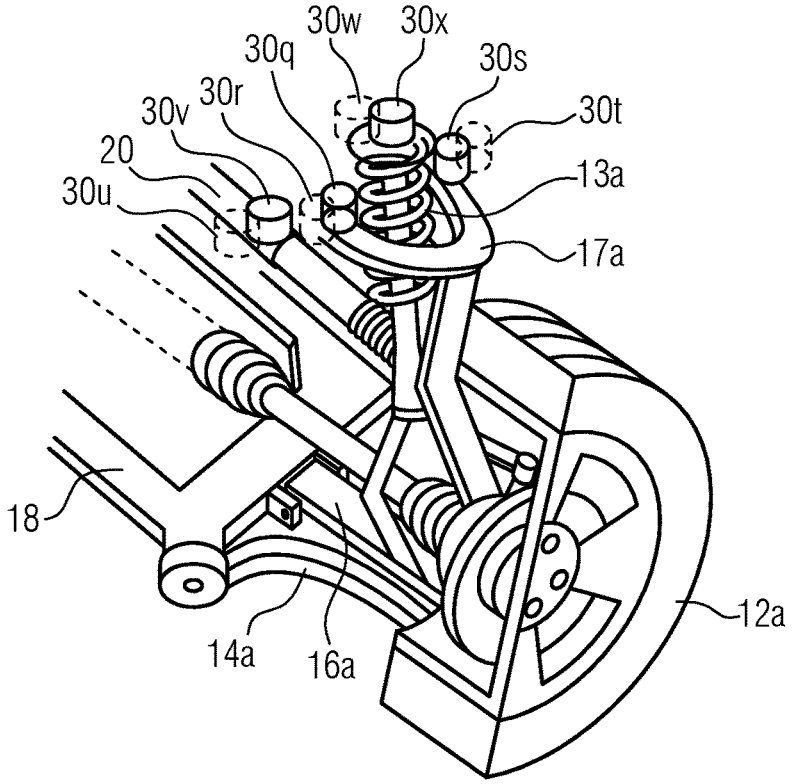
FIG. 4 is a corresponding illustration of the front wheel suspension system and illustrates placement of the vibrational sensors according to an embodiment of the disclosure.

FIG. 3 is a plan view from below of a front portion of the underside of the vehicle according to FIG. 2. FIG. 4 is a corresponding illustration of the front wheel suspension system and illustrates placement of the vibrational sensors according to an embodiment of the disclosure.

Each front wheel 12*a*, 12*b* is mounted on a wheel hub (not shown), each wheel hub is coupled to the subframe 18 by a first lower control arm 14*a*, 14*b* and by a second lower control arm 16*a*, 16*b*. The first lower control arm 14*a*, 14*b* and the second lower control arm 16*a*, 16*b* are also pivotally coupled to the subframe 18. The vehicle 10 also comprises one or more upper control arms 17*a* to form a double wishbone suspension configuration as shown in FIG. 4. The upper control arm 17*a* is pivotally coupled to the subframe 18. A coilover damper 13*a* comprising a coil spring and a damper is coupled to the lower control arms 14*a*/16*a* and 14*b*/16*b* or to the wheel hub, at its base and to the subframe 18, or body 8, at the top. A steering mechanism or rack 20 is coupled between each of the front wheels 12*a*, 12*b* by link arms and is mounted by bushes or supports to the subframe. It is understood that the wheel suspension shown in FIGS. 3 and 4 represents an illustrative example only to demonstrate the present disclosure but that the described calibration system and method are not limited to the particular choice of suspension. In fact, the present disclosure may be applied to any kind of suspension as well as any road-based vehicle.

A plurality of vibrational sensors 30*a-x* is shown mounted on structure elements in FIGS. 3 and 4. As shown in FIG. 3, a rather large number of 16 vibrational sensors 30*a-p* may be mounted on structure elements associated with the front of the vehicle. When using two-dimensional accelerometers for the sensors, a total of 32 vibrational input signals will be generated by these sensors in operation of the automatic calibration system. FIG. 3 shows a symmetric arrangement of the sensors with respect to a longitudinal axis of the vehicle. Such a symmetric arrangement is, however, not essential. In fact, a non-symmetric arrangement can be used to virtually increase the number of mounting points as results from one side of the vehicle can generally be applied to the other side of the vehicle.

Based on axle and suspension design or information from a vehicle design database, the vibrational sensors, respectively the vibrational input signals, may be divided into proper subsets which may partially overlap. By way of example, sensors 30*a*, 30*b*, 30*g-i*, 30*k* and 30*m-n* may form a first subset, based on their association with the left wheel 12*a* in FIG. 3 while sensors 30*c-f*, 30*j*, 301 and 30*o-p* may form a second subset, based on their association with the right wheel 12*b*. Vibrational input signals from corresponding sensors of these two subsets will likely be largely correlated due to their symmetric mounting positions. Consequently, combining sensors from these two subsets will unnecessarily increase the size of the numerical problem.

Depending on their mounting positions, further and smaller subsets may be formed. By way of example, sensors 30*a*, 30*h* and 30*i* may form a third subset with at least one sensor mounted on every possible transfer path. Likewise, sensors 30*b*, 30*g* and 30*i* may form a fourth subset. The multiple-coherence functions for at least one acoustic input signal captured by a microphone inside the vehicle cabin 11 and the vibrational input signals generally differ for the third and fourth subsets due to the different mounting points of the vibrational sensors, reflecting a different coherence between the vibrations of the structure elements where the respective sensors are mounted and the acoustic input signal. As the first subset comprises all the sensors of the third and fourth subsets, the multiple-coherence for the first subset is naturally larger than for the third and fourth subsets. However, the difference may be small, especially for a particular road noise resonance if some of the sensors are either strongly correlated with the other sensors or mounted on a structure element which does not contribute to the transfer path of this particular road noise resonance. In that case, a smaller subset such as the third or fourth subset may suffice to effectively carry out active road noise control in the production vehicle.

FIG. 3 shows sensors 30*b* and 30*k* as dashed circles, indicating that these sensors are not required for ARNC because they are strongly correlated with the other sensors. The above described method and system provide an efficient way to eliminate unnecessary vibrational sensors from the plurality of sensors by comparing the multiple-coherence functions calculated for the various subsets. This elimination may be performed in two phases: In a first phase, strongly correlated vibrational input signals may be eliminated from the subsets by analyzing the auto- and cross-power spectra matrices as described above. In a second phase, the remaining subset with the largest value of the respective multiple-coherence function for the specific road noise resonance frequency may be selected to determine the optimal arrangement of reference sensors for ARNC of this resonance. Although only a small number of subsets and vibrational input signals were discussed herein, it shall be understood that the described method is particularly powerful for large ensembles of vibrational input signals and large numbers of small-sized subsets. The number of subsets should be at least as large as the number of structural resonances coherent with the road noise in the cabin, preferably at least twice as large.

Vibrational sensors which are mounted in close proximity to each other such as the pairs 30*q* and 30*r*, 30*s* and 30*t*, 30*u* and 30*v*, and 30*w* and 30*x* in FIG. 4 are generally strongly correlated such that one of each of the pairs of corresponding vibrational input signals will generally be eliminated during the calibration process, as indicated by the dashed lines. The remaining sensors are good candidates for the reference sensors but only the sensors of the determined optimal arrangement will ultimately be mounted on the production vehicle to reduce production cost and enable real-time ARNC.

Figure 5:
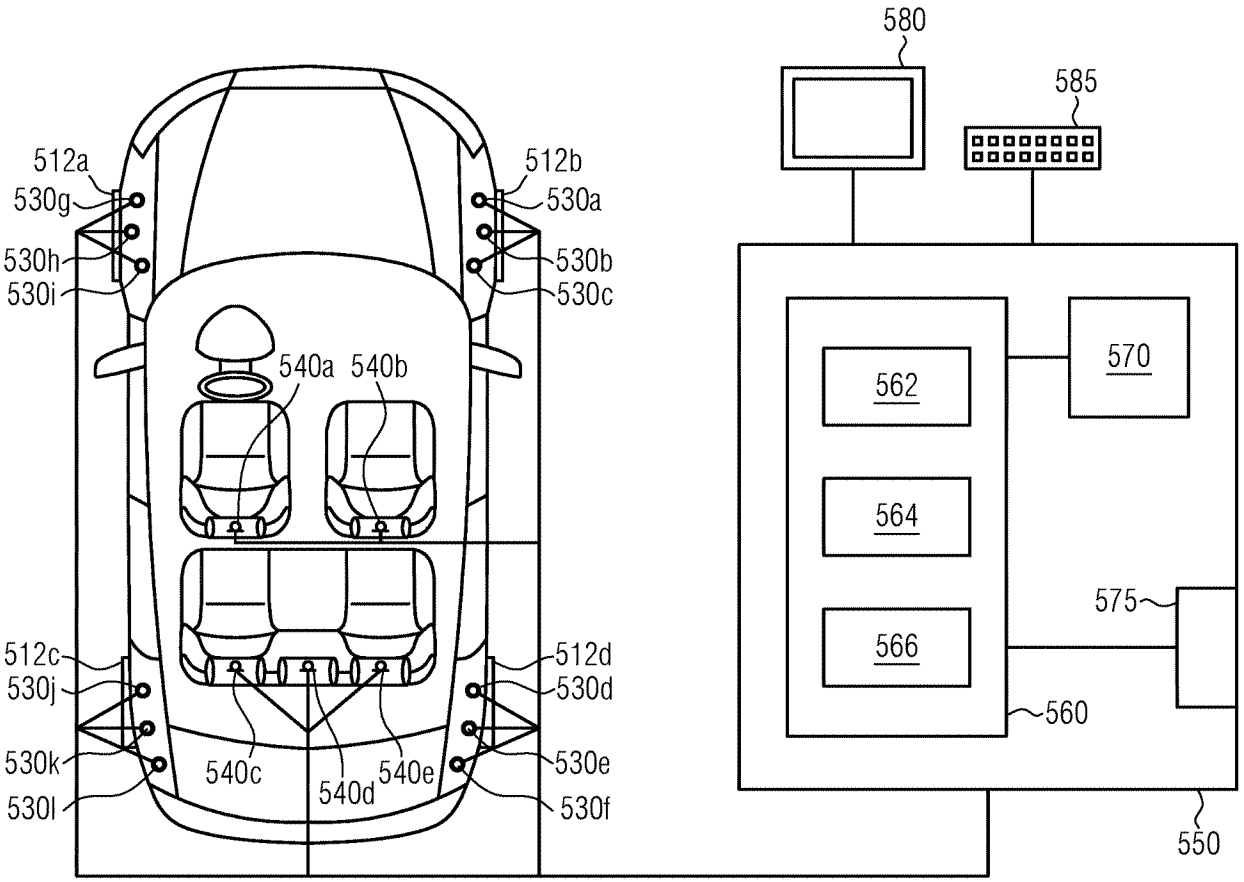
FIG. 5 shows a schematic representation of a vehicle test stand with the automatic calibration system according to the present disclosure connected to the test vehicle.

FIG. 5 shows a schematic representation of a vehicle test stand with the automatic calibration system according to the present disclosure connected to the test vehicle. For simplicity, only three vibrational sensors are shown per wheel/suspension, i.e., sensors 530*a-c* for wheel 512*b*, sensors 530*d-f* for wheel 512*d*, sensors 530*g-i* for wheel 512*a* and sensors 530*j-l* for wheel 512*c*. It is clear that a significantly larger number of sensors may be used and that the mounting points shown in the Figure only serve to illustrate the system. In the depicted embodiment, all sensors 530*a-l* are connected with the processing unit 550 of the automatic calibration system via cables. Equally, all microphones 540*a-e* provided in the head room of the driver and the four potential passengers, e.g., integrated in the head rests, are connected via cables with the processing unit 550. The microphones 540*a-e* are shown in this illustrative example to be provided near or inside the headrests. They may, however, also be provided in the headliner above the head rests, and may in particular be provided as part of an engine order cancellation (EOC) system of the vehicle. Sensors and/or microphones may alternatively be connected wirelessly with a transceiver 575 of the processing unit 550 or with an audio system (not shown) of the vehicle which connects with the processing unit 550 via cable or wirelessly. The measurements for the calibration may be performed on a roller rig with a stationary vehicle. This has the advantage that undesired wind friction noise is eliminated for the analysis of the structure borne road noise. The roller rig may be provided in an anechoic chamber to avoid the detrimental influence of noise reflections. The vehicle is then operated at a constant rotation speed of the wheels to produce stationary vibrational input signals in the vibrational sensors 530*a-l* and stationary acoustic input signals in the microphones 540*a-e*. These signals are transmitted to the processing unit 550 where they are processed by the multiple-coherence calculation unit 560.

As shown in FIG. 5, the multiple-coherence calculation unit 560 may comprise a Fourier transform unit 562 and an eigenvalue calculation unit 564 to process the sampled time series of input signals into auto- and cross-power spectra matrices which are then diagonalized to compute the multiple-coherence functions for each subset and each acoustic input signal as described above. To reduce the size of the subsets, a subset size reduction unit 566 may detect pairs of vibrational input signals with high correlation and eliminate one of the signals as described above. A selection unit 570 of the processing unit 550 then selects a subset for each acoustic input signal as the optimal arrangement of reference sensors for ARNC of the acoustic input signal based on the calculated multiple-coherence function. The result may be displayed in a display device 580, such as an LCD display or a touch screen, of the calibration system.

The calibration system may further include an input device 585 such as a keyboard, touch panel, touch screen, mouse or the like for user input. A user may in particular influence the definition of the subsets and the selection of detected road noise resonances for calibration via the input device 585. Also, a frequency range for the multiple-coherence functions or other parameters such as sampling rate, frequency resolution, maximum and minimum subset size, etc. may be set via the input device.

The calibration system may include a transceiver 575 for communication with the vehicle and/or a wireless network, for instance for accessing a vendor's vehicle data base. Further components may be provided as needed for interaction with vehicle components, a user and/or the test stand.

Figure 6:
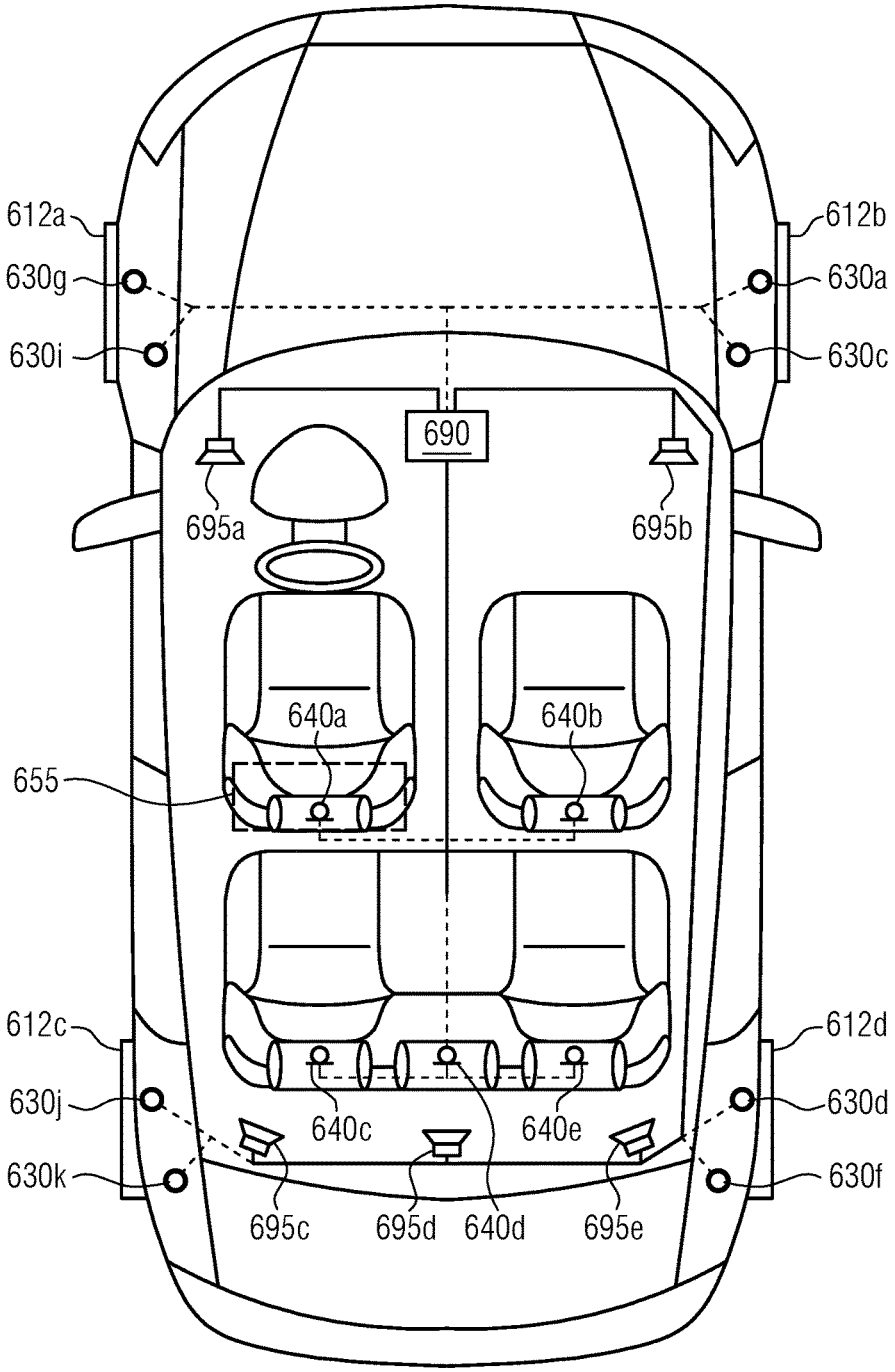
FIG. 6 shows a schematic representation of a vehicle with an active noise control system according to the present disclosure installed therein.

FIG. 6 shows a schematic representation of a vehicle with an active noise control system according to the present disclosure installed therein. As a result of the above described calibration method and system, a subset including two reference sensors was identified for each wheel. The Figure shows reference sensors 630*a* and 630*c* for wheel 612*b*, reference sensors 630*d* and 630*f* for wheel 612*d*, reference sensors 630*g* and 630*i* for wheel 612*a*, and reference sensors 630*j* and 630*k* for wheel 612*c*. It shall be understood that the number and locations of the reference sensors shown in the Figure are selected for illustrative purposes only and do not limit the scope of the present disclosure.

The reference sensors are connected with the adaptive filter system 690 of the ARNC system via cables or wirelessly as indicated by the dashed lines. Furthermore, a total of five error microphones 640*a-e* provided inside or near the head rests of the driver and the four possible passengers are connected with the adaptive filter system 690. Again, headliner microphones may be provided instead or in addition, in particular as part of an EOC system. Finally, a speaker arrangement with five speakers 695*a-e* is connected with the adaptive filter system 690. The number and arrangement of the microphones and speakers are chosen for illustrative purposes only. Also, the adaptive filter system 690 may be part of the audio system of the vehicle which also includes the speaker arrangement and the error microphones. Consequently, an existing audio system of a vehicle may be extended by the depicted reference sensors and connections as well as the described adaptive filter unit or module to implement ARNC according to the present disclosure.

As described above, the adaptive filter system 690 receives a plurality of reference signals from the reference sensors and processes them on the basis of a plurality of transfer functions for the reference signals with respect to one or several predetermined quiet zones in the cabin of the vehicle to generate a cancellation signal. The cancellation signal is then output by the speakers 695*a-e* to cancel out the road noise transmitted from the tires/wheels into the quiet zone 655 of the driver. Respective cancellation signals may be generated for the quiet zones of the passengers (not shown). Beamforming of the sound waves output by the speakers 695*a-e* may be used to cancel the road noise inside multiple quiet zones.

A remnant noise signal is then captured by the error microphones 640*a-e* and input to the adaptive filter system 690 which may subtract an audio signal output by the vehicle's audio system, background noise for engine or other NVH sources and/or a speech signal to isolate the remaining road noise. Based on the remnant road noise signal, one or several filter coefficients of the adaptive filter system 690 may be updated in a feedback loop as known in the art.

Due to the small number of reference sensors per subset (here two), calculation of the virtual vibration signals for ARNC is fast and can be performed in real time such that the described ARNC system can easily account for variations in the road noise, for instance due to varying speed or road conditions. Consequently, dominant road noise resonances can be effectively cancelled out, thereby significantly increasing the comfort of the driver and the passengers without complex adaptations of the vehicle design or appreciable increase of vehicle mass.

What is claimed is:

1. A method for determining an arrangement of at least one reference sensor for active road noise control (ARNC) in a vehicle with an automatic calibration system, the method comprising:

mounting a plurality of vibrational sensors of the automatic calibration system on a plurality of structure elements of the vehicle, the structure elements representing strongest contributions to a transfer of road noise into a cabin of the vehicle, and the vibrational sensors being configured to generate a plurality of vibrational input signals based on vibrations of the respective structure elements and to input the plurality of vibrational input signals to a processing unit of the automatic calibration system;

mounting at least one microphone of the automatic calibration system inside the cabin of the vehicle, the at least one microphone being configured to capture at least one acoustic input signal and to input the captured at least one acoustic input signal to the processing unit; and determining the arrangement of the at least one reference sensor from the plurality of vibrational sensors with the processing unit by determining a subset of vibrational sensors which sense main mechanical inputs of road noise contributing to the at least one acoustic input signal; and wherein determining the arrangement of the at least one reference sensor includes:

forming a plurality of proper subsets of vibrational input signals from the plurality of vibrational input signals;

calculating a multiple-coherence function for each of the proper subsets of the vibrational input signals and for each of the at least one acoustic input signal using the processing unit to determine a coherence between the respective acoustic input signal and the vibrational input signals of the respective subset; and for each of the at least one acoustic input signal, automatically selecting with the processing unit, the proper subset based on the calculated multiple-coherence function as the arrangement of the at least one reference sensor for the ARNC of the at least one acoustic input signal.

2. The method of claim 1, wherein the plurality of vibrational sensors is accelerometers configured to generate the plurality of vibrational input signals.

3. The method of claim 1 further comprising:

determining a road noise spectrum from the at least one acoustic input signal with the processing unit;

determining at least one resonance frequency from the road noise spectrum with the processing unit; and automatically selecting, with the processing unit, a first subset for which the multiple-coherence function evaluated at a first determined resonance frequency is maximum as the arrangement of the at least one reference sensor.

4. The method of claim 3 further comprising:

automatically selecting, with the processing unit, a second subset for which the multiple-coherence function evaluated at a second determined resonance frequency is maximum; and combining the first and second subsets to determine the arrangement of the at least one reference sensor.

5. The method of claim 1, wherein calculating the multiple-coherence function comprises:

processing a time series of the plurality of vibrational input signals with the processing unit to compute an auto- and cross-power spectra matrix of the respective vibrational input signals for each of the subsets;

performing singular value decomposition of the computed auto- and cross-power spectra matrices by the processing unit to determine diagonal power spectrum matrices with respect to virtual vibration signals; and calculating the multiple-coherence functions for the subsets based on cross-power spectra between the virtual vibration signals and the at least one acoustic input signal.

6. The method of claim 5 further comprising:

for at least one of the subsets, determining with the processing unit, a pair of vibrational input signals having a largest cross-power spectrum of the computed auto- and cross-power spectra matrix;

automatically eliminating one vibrational input signal of the pair of vibrational input signals and a corresponding vibrational sensor from the subset; and calculating the multiple-coherence function for a reduced subset.

7. The method of claim 6, wherein the one vibrational input signal is only eliminated if a corresponding cross-power spectrum is larger or equal than a predetermined threshold.

8. The method of claim 1, wherein the plurality of vibrational sensors comprises at least a first group of vibrational sensors and a second group of vibrational sensors, the first group of vibrational sensors being mounted on structure elements associated with a front axle of the vehicle, and the second group of vibrational sensors being mounted on structure elements associated with a rear axle of the vehicle; and wherein the subsets of the plurality of vibrational input signals are formed so as to avoid combining the plurality of vibrational input signals from different groups.

9. An automatic calibration system for determining an arrangement of at least one reference sensor for active road noise control (ARNC) in a vehicle, the system comprising:

a processing unit;

a plurality of vibrational sensors mountable on a plurality of structure elements of the vehicle and configured to generate a plurality of vibrational input signals based on vibrations of the plurality of structure elements and to input the plurality of vibrational input signals to the processing unit;

wherein the plurality of structure elements represent strongest contributions to a transfer of road noise into a cabin of the vehicle; and at least one microphone mountable inside the cabin of the vehicle and configured to capture at least one acoustic input signal and to input the captured at least one acoustic input signal to the processing unit;

wherein the processing unit is configured to determine the arrangement of the at least one reference sensor from the plurality of vibrational sensors by determining a subset of vibrational sensors which sense main mechanical inputs of road noise contributing to the at least one acoustic input signal; and wherein the processing unit comprises:

a multiple-coherence calculation unit configured to calculate a multiple-coherence function for each of a plurality of proper subsets of vibrational input signals formed from the plurality of vibrational input signals and for each of the at least one acoustic input signal to determine a coherence between the respective acoustic input signal and the vibrational input signals of the respective subset.

10. The system of claim 9, wherein the processing unit further comprises:

a selection unit configured to automatically select, for each of the at least one acoustic input signal, a proper subset based on the calculated multiple-coherence function as the arrangement of the at least reference sensor for the ARNC of the at least one acoustic input signal.

11. The system of claim 10, wherein the plurality of vibrational sensors is accelerometers configured to generate the plurality of vibrational input signals.

12. The system of claim 10, wherein the multiple-coherence calculation unit comprises:

a Fourier transform unit configured to process a time series of the plurality of vibrational input signals to compute an auto- and cross-power spectra matrix of the respective vibrational input signals for each of the subsets; and an eigenvalue calculation unit to perform singular value decomposition of the computed auto- and cross-power spectra matrices to determine diagonal power spectrum matrices with respect to virtual vibration signals;

wherein the multiple-coherence calculation unit is configured to calculate the multiple-coherence functions for the subsets based on cross-power spectra between the virtual vibration signals and the at least one acoustic input signal.

13. The system of claim 12, wherein the multiple-coherence calculation unit comprises a subset size reduction unit configured to determine a pair of vibrational input signals having a largest cross-power spectrum of the computed auto- and cross-power spectra matrix for at least one of the subsets; and to eliminate one vibrational input signal of the pair of vibrational input signals and a corresponding vibrational sensor from the subset; and wherein the multiple-coherence calculation unit is further configured to calculate the multiple-coherence function for a reduced subset.

14. An automatic calibration system for determining an arrangement of at least reference sensor for active road noise control (ARNC) in a vehicle, the system comprising:

a processing unit configured to receive a plurality of vibrational input signals;

a plurality of vibrational sensors mountable on a plurality of structure elements of the vehicle and configured to generate the plurality of vibrational input signals based on vibrations of the plurality of structure elements;

wherein the plurality of structure elements is indicative of contributions to a transfer of road noise into a cabin of the vehicle; and at least one microphone positioned within the cabin of the vehicle and configured to capture at least one acoustic input signal and to provide the captured at least one acoustic input signal to the processing unit;

wherein the processing unit is configured to determine the arrangement of at least one reference sensor from the plurality of vibrational sensors by determining a subset of vibrational sensors which sense main mechanical inputs of road noise contributing to the at least one acoustic input signal; and wherein the processing unit comprises:

a multiple-coherence calculation unit configured to calculate a multiple-coherence function for each of a plurality of proper subsets of vibrational input signals formed from the plurality of vibrational input signals and for each of the at least one acoustic input signal to determine a coherence between the respective acoustic input signal and the vibrational input signals of the respective subset.

15. The system of claim 14, wherein the processing unit further comprises:

a selection unit configured to automatically select, for each of the at least one acoustic input signal, a proper subset based on the calculated multiple-coherence function as the arrangement of the at least reference sensor for the ARNC of the at least one acoustic input signal.

16. The system of claim 15, wherein the plurality of vibrational sensors is accelerometers configured to generate the plurality of vibrational input signals.

17. The system of claim 15, wherein the multiple-coherence calculation unit comprises:

a Fourier transform unit configured to process a time series of the plurality of vibrational input signals to compute an auto- and cross-power spectra matrix of the respective vibrational input signals for each of the subsets; and an eigenvalue calculation unit to perform singular value decomposition of the computed auto- and cross-power spectra matrices to determine diagonal power spectrum matrices with respect to virtual vibration signals;

wherein the multiple-coherence calculation unit is configured to calculate the multiple-coherence functions for the subsets based on cross-power spectra between the virtual vibration signals and the at least one acoustic input signal.

* * * * *